United States Patent [19]

Brossman

[11] Patent Number: 4,578,965

[45] Date of Patent: Apr. 1, 1986

[54] AUTOMATIC PATTERN REGISTRATION WITH OSCILLATING STRUCTURE

[75] Inventor: William C. Brossman, Terre Hill, Pa.

[73] Assignee: Armstrong World Industries, Inc., Lancaster, Pa.

[21] Appl. No.: 692,501

[22] Filed: Jan. 18, 1985

[51] Int. Cl.[4] ..... D06B 1/02; D06B 11/00

[52] U.S. Cl. ..... 68/205 R; 118/674; 118/697; 118/323

[58] Field of Search ..... 68/205 R; 118/674, 697, 118/323

[56] References Cited

U.S. PATENT DOCUMENTS 3,899,903 8/1975 Lapierre ..... 68/205 R
4,033,154 7/1977 Johnson ..... 68/205 R
4,431,690 2/1984 Matt et al. ..... 118/674 X
4,463,467 8/1984 Gruber et al. ..... 68/205 R X

*Primary Examiner*—Philip R. Coe

[57] ABSTRACT

An apparatus for maintaining the relationship of a transverse oscillating mechanical production member containing dye valves with a product moving linearly at a relatively high speed and with the program of operation of the valves. Encoders related to both the linear motion and the transverse motion are continuously monitored and the speed of the oscillating element adjusted to match the linear motion while a proximity switch operated at one point in the oscillating member cycle monitors the synchronization of the oscillating member which is adjustable once every cycle to maintain synchronization.

10 Claims, 1 Drawing Figure

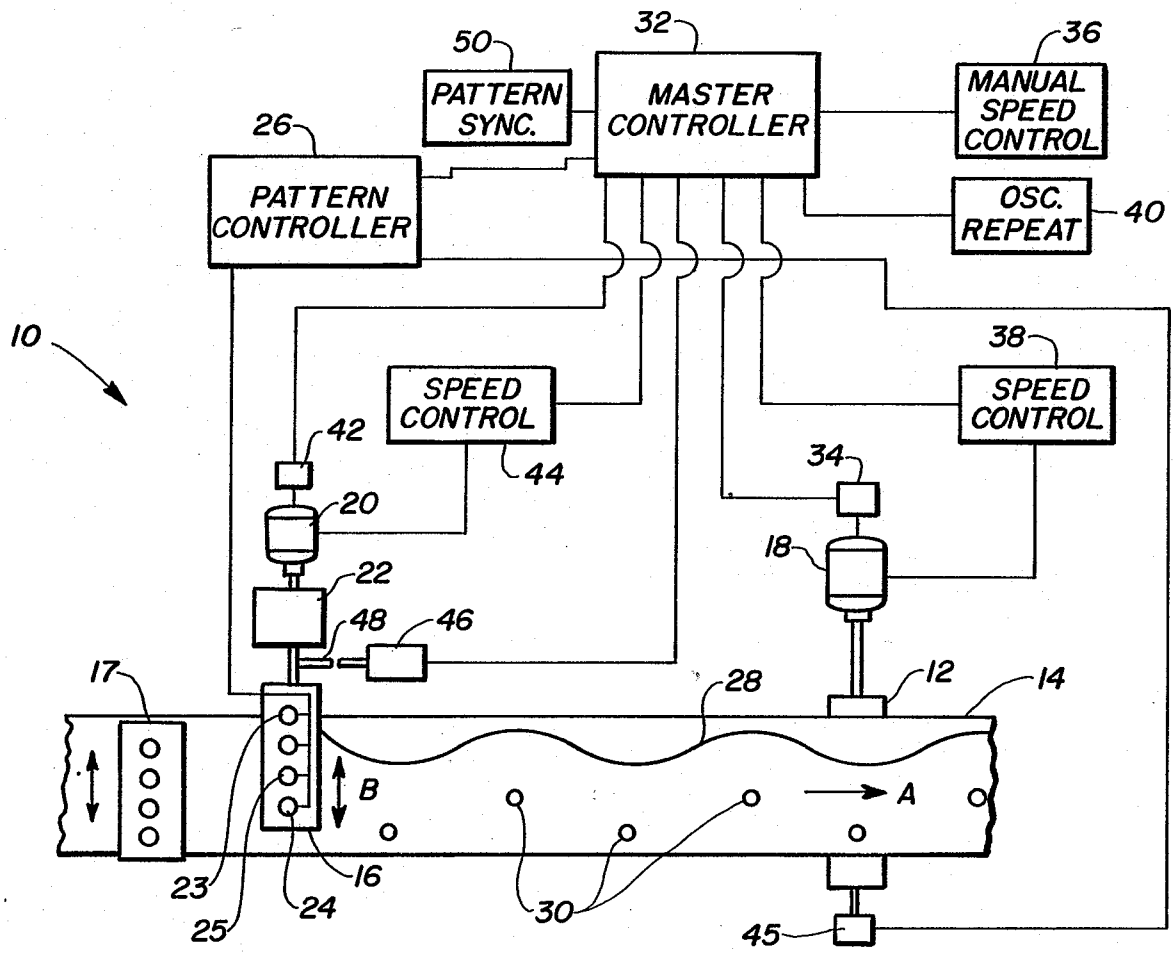
MANUAL SPEED CONTROL
36
OSC. REPEAT
40
SPEED CONTROL
38
MASTER CONTROLLER
32
PATTERN SYNC.
50
PATTERN CONTROLLER
26
SPEED CONTROL
44
14
12
A
34
18
45
28
30
46
22
48
20
42
B
16
24
25
23
17
10

AUTOMATIC PATTERN REGISTRATION WITH OSCILLATING STRUCTURE

SUMMARY OF THE INVENTION

This invention deals generally with process control and more specifically with control of a dyeing apparatus in which a moving strip or sheet of material is sprayed with dye from a transversely moving station which has several spray nozzles upon it.

The typical equipment used to apply color patterns to moving strip or sheet material, such as carpet, involves moving the material by means such as rollers along a surface over which are located dye spray heads. These spray heads are typically constructed so that several of them are located on a structure oriented transverse to the moving strip, and the apparatus is designed so that the spray head structure moves back and forth transversely across the moving material. The combination of the motion of the material and the motion of the spray structure, along with the timing of the spray heads, yields a pattern of dye on the material.

A simple example of this action is when the transverse structure moves back and forth at a uniform speed with the spray heads operating continuously as the material moves under it. Such an arrangement would yield a pattern of adjacent wiggly lines, more specifically, wave patterns. Adjustment of the size of the spray pattern from each head and the spreading effect of the dye on the material would determine the width of the individual lines of the pattern.

Another example of the effect of the apparatus can be understood when the spray heads are operated intermittently for short time periods when the operating time of the spray heads is short relative to the speed of the moving strip. In such a case, and with a continuous uniform speed of the transverse structure and operation of the spray nozzles at regular repeating intervals, the resulting pattern from each spray head would be a series of spots, also following a wave path.

It can readily be appreciated that, as the timing of the material movement, the transverse structure, and the spray heads is varied, many patterns can result. Moreover, if the transverse structure is also moved much more than the spacing between heads, as the timing of the spray from each nozzle is varied relative to the other nozzles, and as additional transverse structures are added along the path of the material, the resulting patterns become more complex and can take on the appearance of random patterns.

In the commercial area of salable products, it is the appearance of a random pattern that is frequently desirable. However, true random patterns are extremely difficult to achieve in a machine where the transverse structure is moved by cyclic mechanical means, and it is just that type of machine which is in general use in industry. The actual problem arising is not only that the resulting pattern is not random, but that, in fact, the pattern is noticeably repetitious. Moreover, the repeating features are sometimes highly visible and undesirable, such as those caused by the overlap of two different color spots.

Such problems are the result of the timed relationship between the operation of the dye nozzles and the oscillating structure upon which they sit and the interplay between several of these configurations. Moreover, since each oscillating structure is operated by a separate electric motor, even, if by analysis and study, a satisfactory pattern is attained and all motor speeds are set identically, the independent motors are actually always at slightly different speeds and the pattern nevertheless changes slowly.

At present, the furnished pattern is continuously inspected by a skilled and experienced operator and continuous speed adjustments are made during production. It is clear that such a procedure is not adapted to high production and, in fact, an unsatisfactory product is a frequent result even at low production speeds.

The present invention removes the entire control process from the realm of the operator and makes it completely automatic. By the use of electronic control and feedback technology, it times both the operation of all the dye valves and the movement of the several oscillating structures relative to the speed of the product. Moreover, once phase relationship between dye valves and oscillating structure movement is set, the control system continuously checks and adjusts the system parameters to maintain the exact prescribed settings.

Such an arrangement can produce, if not a true random pattern, one which, while actually having a cyclic repeat, appears random, meaning in fact that the repeat is infrequent enough to satisfy the visual test by the product designer. More important the pattern repeats faithfully, with no anomalies caused by slight drifts in motor speeds.

This result is accomplished by using a control system which takes its primary timing signals from the roller which moves the material through the apparatus. In the preferred embodiment, two encoders are connected to the motor driven material roller. The first feeds a timed pulse signal to a pattern controller which controls the operation of the dye valves located on the oscillating structure. The second encoder feeds an electrical speed signal to the master controller. Since the encoders are actually on the same rotating shaft, the shaft of the material drive roller, they are themselves synchronized. The use of two separate encoders, however, provides electronically isolated but numerically related signals.

The pattern controller selects the particular timing of the operation of the several dye valves to produce the desired color pattern on the product strip. In the preferred embodiment the pattern controller is actually a computer. This is particularly advantageous for varying the pattern and storing previous pattern control sequences, but other devices could also be used for pattern control, including such a basic apparatus as motor driven timers. Along with generating the specific timing control signals for each of the several dye valves, the pattern controller generates a pattern synchronization pulse which is transmitted to the master controller for comparison to the other critical signals in the system and for use in control of the entire system.

Two other signals are also generated and sent to the master controller. One signal is generated by an encoder attached to the motor which drives the transverse oscillating structure upon which the dye valves are mounted. This furnishes a speed signal for the oscillating structure. The other signal is generated by a proximity switch which monitors the transverse motion of the oscillating structure. This proximity switch generates a signal only when the oscillating structure is in a particular location during its motion.

The several electrical signals are therefore generated and sent to the master controller in response to (1) the speed of the product drive roller, (2) the synchronization of the dye valves, (3) the speed of the oscillating structure and (4) a unique position of the oscillating structure.

The master controller independently controls the speed of both the product drive roller and the transverse oscillating structure relative to a manually controlled product speed setting which is set by the machine operator, but, more important, it continuously checks and readjusts the synchronization of the dye valve operation and the speed of the oscillating structure to synchronize them with the motion of the product through the machine.

Moreover, since most production machines have more than one transverse oscillating structure, the master controller maintains the proper phase relationship relative to the product motion, not only of the several dye valves relative to their own oscillating motion, but also of each of the several oscillating structures relative to each other.

By this means the present invention generates exact repeating patterns on any material without any cummulative error or drift in the pattern and thereby assures high quality product regardless of machine speed drift or operator error.

BRIEF DESCRIPTION OF THE DRAWINGS

The FIGURE is a simplified block diagram of the control system of the present invention.

DETAILED DESCRIPTION OF THE INVENTION

The preferred embodiment of the invention is depicted in the FIGURE which is a simplified block diagram of carpet decorating machine 10 in which carpet roller 12 moves carpet 14 in direction A under transverse oscillating structures 16 and 17. Roller 12 is rotated by motor 18, while oscillating structure 16 is moved in direction B, transverse to direction A, by motor 20 which powers cam system 22 which converts the rotary motion of motor 20 into the transverse oscillation required by structure 16. Transverse oscillating structure 17 is similar to structure 16 and is powered and controlled in a similar fashion, but for clarity its attached devices and control connections are not shown.

Several dye valves 23, 24, and 25 with nozzles (not seen) on the underside of structure 16 are attached to oscillating structure 16 and are independently controlled by pattern controller 26. Therefore, as carpet 14 moves under structure 16 and the valves are opened to spray dye from their respective nozzles, dye pattern 28 is produced on carpet 14. Dye pattern 28 is shown as a wave which might be the result of dye valve 23 being continuously open with a specific speed of oscillation for structure 16. Similarly, spot pattern 30 is the result of intermittent operation of valve 24.

The typical pattern which is produced by such machines as carpet decorating machine 10 is a repeating pattern of some sort with a pattern repeat cycle of, for instance, 36 inches. Also typically, the dye valves are spaced at about one inch intervals across the carpet on oscillating structure 16. Since the transverse motion of structure 16 is considerably greater than the one inch spacing between valves, the actual patterns produced by the several valves overlap. Moreover, the patterns are further complicated by additional oscillating structures such as structure 17.

Pattern controller 26, typically an electronic computer, is used to control the multitude of valves to produce the desired pattern by proper sequencing of the valves.

However, control of the pattern resulting on finished product also depends upon the speed of motors 18 and 20 which respectively control the motion of carpet 14 and oscillating structure 16. Moreover, oscillating structure 17 has its own motor (not shown), as does any other additional transverse oscillating structure on the production line. To produce high quality repeating patterns, it is also necessary to accurately control these other motors.

This task and that of synchronizing the actions on all the components of the apparatus is accomplished by master controller 32.

Master controller 32 is fed electrical signals from the various components to indicate the particular status of each. Speed monitor 34, typically an optical encoder, is associated with motor 18 and produces a signal related to the speed of carpet roller 12. This signal is fed to master controller 32 and compared to the setting of manual speed control 36. A feedback circuit internal to master controller 32 then instructs motor speed control 38 to adjust the speed of motor 18 if required. The signal from speed monitor 34 is also used to control the speed of motor 20 which drives oscillating structure 16 at a speed related to the speed of motor 18. The speed relationship between the motors is determined by master controller 32 based on the pattern desired.

The speed of motor 20 is regulated in a similar manner to that of motor 18, except that it is manually controlled by oscillation repeat control 40. Speed monitor 42, typically an optical encoder, produces a signal related to the speed of motor 20. This signal is sent to master controller 32 which compares it to the speed of motor 18 and adjusts the speed of motor 20, by means of its motor control 44, so that the speed of motor 20 is correct, relative to the speed of motor 18, for the selected pattern. For instance, if it is desired to have four cycles of oscillating structure 16 for every 36 inch length of carpet, oscillation repeat control 40 establishes the appropriate ratio of the speed of motor 20 to that of motor 18 to accomplish that, regardless of the speed of the carpet strip. Master controller 32 then maintains the proper ratio by continuous comparison of the two motor speeds and correction of the speed of motor 20. This is accomplished by conventional feedback circuitry.

Speed alone is, however, not the sole criterion of a correct design. The other critical factor is synchronization of the mechanical motion of oscillating structure 16 with the operation of valves 23, 25 and 24. Master controller 32 also verifies and adjusts this synchronization.

To accomplish this, pattern controller 26 generates and sends to master controller 32 a pattern synchronization pulse once during each of its pattern cycles. This pulse is accurately timed relative to the pattern being generated, for instance it might be simultaneous with the exact opening of the first valve to generate the designed pattern cycle. Master controller 32 is thereby furnished with an electrical signal precisely related to the repeating action of the dye valves.

Pattern controller 26 is itself timed relative to a synchronization pulse furnished from encoder 45 which is on the shaft of carpet roller 12 and produces a signal related to the speed of carpet roller 12. In the preferred embodiment, an encoder is used which generates 14 pulses for each inch of carpet motion. Therefore, for a 36 inch repeating pattern, pattern controller 26 is programmed to repeat its pattern once every 504 pulses. Various intermediate pulse counts can then be used to activate the various valves. This automatically adjusts the operation of the dye valves to the carpet speed.

Master controller 32 is also supplied with an electrical signal precisely related to the location of the oscillating structure. Proximity switch 46 furnishes this signal each time activating element 48 passes it as oscillating structure 16 moves back and forth. Conventional proximity switch systems make it possible to distinguish the direction of motion, for instance, by switch 46 actually including two adjacent switches and a discriminating circuit to transmit only if one sequence of operation of the two switches occurs. Switch 46, therefore, sends a signal to master controller 32 which is timed precisely to when oscillating structure 16 passes a certain point in its cyclic travel path.

Master controller 32 then compares the synchronization pulse received from pattern controller 26 and the timed signal received from proximity switch 46 and checks them against the relationship required by the pattern synchronization control 50, which is manually set by the operator. If correction is required master controller 32 momentarily varies the speed of motor 20 to reestablish correct synchronization.

The synchronization of the pattern is therefore maintained by operating the dye valve cycle from encoder 45 and relating the speed of oscillating structure 16 to speed monitor 34, both encoder 45 and speed monitor 34 being related to the speed of roller 12. Operating through master controller 32 which maintains the relationships once they are manually set by the operator, oscillation repeat control 40 determines the number of mechanical oscillations for a specific length of carpet; pattern controller 26 determines the pattern of operation of the dye valves; pattern synchronization control 50 controls the relationship of the motion of oscillating structure 16 to the operation of the dye valves; and manual speed control 36 controls the speed of the carpet strip which, in turn, automatically controls the speed of the other actions.

It should be apparent that the addition of another oscillating structure 17 requires only another pattern synchronization control, another oscillation repeat control and another pattern controller. The second pattern controller function is easily within the capability of the typical process control computer which is likely to be used as first pattern controller 26. Such additional pattern producing systems would, however, be synchronized from the signals generated by speed monitor 34 and encoder 45.

A particular advantage of the present invention is that it can easily be added to existing strip product machines. Typically, for such an addition the attachment required would be only shaft encoders 34, 42 and 45 and proximity switch activating element 48. Signal cables from these devices furnish all the information required to accomplish complete control of the system by the usually available motor speed controls and dye valve actuating controls.

It is to be understood that the form of this invention as shown is merely a preferred embodiment. Various changes may be made in the function and arrangement of parts, equivalent means may be substituted for those illustrated and described, and certain features may be used independently from others without departing from the spirit and scope of the invention as defined in the following claims.

For example, encoders 34 and 45 could be combined into a single unit feeding signal to both the pattern controller and the master controller.

What is claimed is:

1. In a material decorating apparatus of the type including a material moving means, a first motor for driving the material moving means, at least one oscillating structure including dispensing means for applying a decorating agent to the material, said oscillating structure oscillating transversely across the material as it moves linearly, a second motor for driving the oscillating structure, and a dispensing means controller, the improvement comprising:

first encoder means connected to the first motor and producing a first electrical signal related to the speed of the first motor;

second encoder means connected to the material moving means and producing a second electrical signal related to the speed of the product;

third encoder means connected to the second motor and producing a third electrical signal related to the speed of the second motor;

position indicating means connected to the oscillating structure and producing a fourth electrical signal related to the position of the oscillating structure;

master control means, connected to the first, second and third encoder means and to the position indicating means and receiving the first, second, third and fourth electrical signals, which maintains the speed of the second motor at a predetermined relationship to the speed of the first motor and maintains a predetermined synchronization of the oscillating structure position with the dispensing means controller operation.

2. The improved material decorating apparatus of claim 1 wherein the predetermined relationship between the speed of the first motor and the speed of the second motor is variable by a manual control.

3. The improved material decorating apparatus of claim 1 wherein the predetermined synchronization of the oscillating structure position with the dispensing means controller operation is variable by a manual control

4. The improved material decorating apparatus of claim 1 wherein the position indicating means produces the fourth electrical signal as the oscillating structure passes a specific location in its path.

5. The improved material decorating apparatus of claim 1 wherein the position indicating means is a proximity switch.

6. The improved material decorating apparatus of claim 1 wherein the material moving means is a roller connected to the shaft of the first motor and second encoder means is connected to the same shaft as the first encoder means.

7. The improved material decorating apparatus of claim 1 wherein the first and second encoder means are combined.

8. The improved material decorating apparatus of claim 1 wherein the second encoder means generates a signal containing a plurality of distinguishable signal times.

9. The improved material decorating apparatus of claim 1 wherein the second encoder means generates a signal containing a plurality of pulses.

10. The improved material decorating apparatus of claim 1 wherein the second encoder means generates a signal containing a plurality of pulses and various pulses are used to control the timing of the dispensing means.

* * * * *